United States Patent [19]

Röhrig

[11] 4,262,733

[45] Apr. 21, 1981

[54] APPARATUS FOR REMOVING AND SIMULTANEOUSLY TURNING CUT-TO-LENGTH HOT STRAND SECTIONS FROM THE DELIVERY ROLLER TABLES OF A MULTISTRAND CONTINUOUS CASTING INSTALLATION

[75] Inventor: Adalbert Röhrig, Wädenswil, Switzerland

[73] Assignee: Concast AG, Zurich, Switzerland

[21] Appl. No.: 132,655

[22] Filed: Mar. 21, 1980

[30] Foreign Application Priority Data

Apr. 6, 1979 [CH] Switzerland ..... 3264/79

[51] Int. Cl.[3] ..... B22D 11/126

[52] U.S. Cl. ..... 164/412; 83/157; 164/263; 164/420; 414/107

[58] Field of Search ..... 164/263, 412, 420; 414/107; 83/157

[56] References Cited

U.S. PATENT DOCUMENTS

| | | | |
|---|---|---|---|
| 3,601,263 | 8/1971 | Stratton et al. | 414/107 |
| 4,202,402 | 5/1980 | Röhrig | 164/263 |

FOREIGN PATENT DOCUMENTS

| | | | |
|---|---|---|---|
| 1602171 | 4/1970 | Fed. Rep. of Germany | 164/412 |

*Primary Examiner*—Robert D. Baldwin

*Attorney, Agent, or Firm*—Werner W. Kleeman

[57] ABSTRACT

An apparatus for the removal, accompanied by simultaneous turning, of cut-to-length hot strand sections from the delivery or run-out roller tables of a multistrand continuous casting installation for steel. The pivot shaft of pivotal levers, provided with receiver or take-up portions for the cut-to-length strand sections, is located below a cooling bed arranged laterally of the delivery or run-out roller tables, approximately at the center between the cooling bed and the roller table located furthest from such cooling bed. By virtue of the foregoing and due to the constructional configuration of the receiving portions or strand section-receivers and a slide or chute operatively associated with the roller table situated closest to the cooling bed, it is possible, with the aid of only one single pivot mechanism or device, to conjointly directly transfer a number of strand sections which are simultaneously turned through an angle of about 90°, from different run-out roller tables, onto the cooling bed and to further displace the entire stack of strand sections.

8 Claims, 3 Drawing Figures

Fig.1
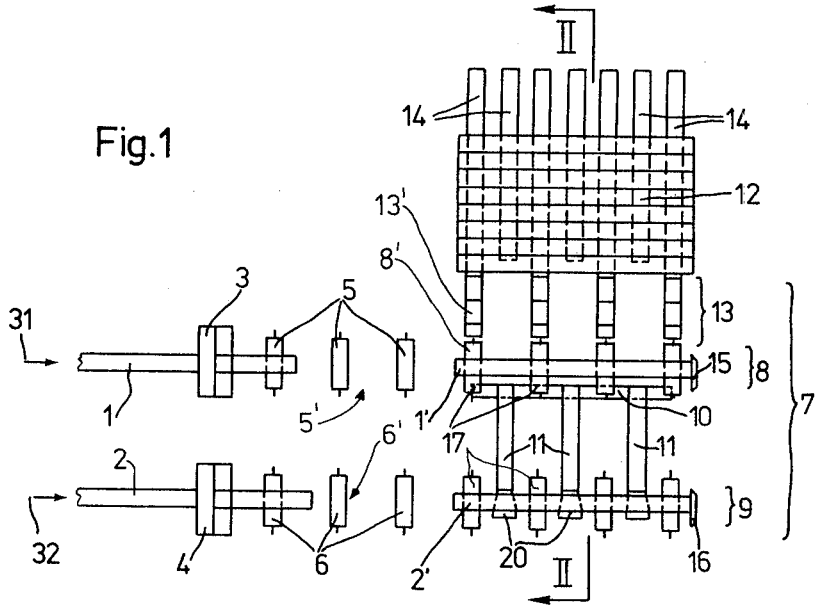
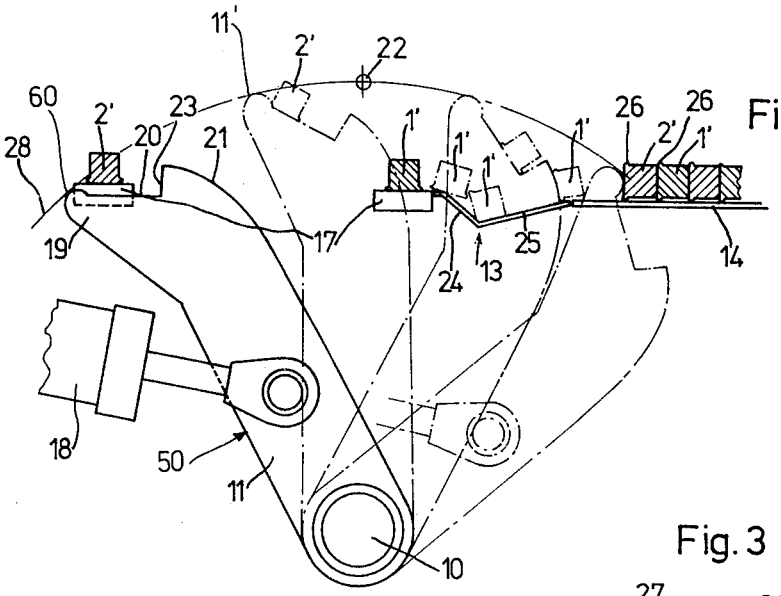
Fig. 2
Fig. 3
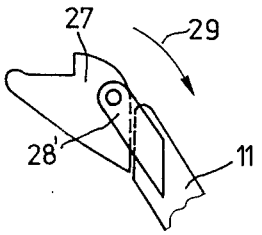

APPARATUS FOR REMOVING AND SIMULTANEOUSLY TURNING CUT-TO-LENGTH HOT STRAND SECTIONS FROM THE DELIVERY ROLLER TABLES OF A MULTISTRAND CONTINUOUS CASTING INSTALLATION

CROSS-REFERENCE TO RELATED CASE

This application is related to the commonly assigned, U.S. Pat. No. 4,202,402, filed Sept. 19, 1977 and entitled "Transfer Device For Billets And Blooms Of A Multistrand Continuous Casting Installation For Metals."

BACKGROUND OF THE INVENTION

The present invention relates to a new and improved construction of apparatus for the removal, accompanied by simultaneous turning of cut-to-length hot strand sections, from the run-out or delivery roller tables of a multistrand continuous casting installation for metals, especially steel, onto a laterally arranged cooling bed with the aid of pivotal levers equipped with receiver means for receiving the strand sections.

With a state-of-the-art cooling bed strand sections are individually taken-over by means of pivotal levers and transferred to a higher situated cooling bed. The cooling bed grate is extended over the roller tables and possesses for each strand track or path of travel pivotable flaps which, during the upward rocking of the individual strand sections, are upwardly pressed by the latter, and thus, free for the individual strand sections the path along the grate. The strand sections are guided along arcuate-shaped guides, opening at the cooling bed plane, upon the cooling bed grate, and they are turned through an angle of 90°. A cooling bed-pushing device thereafter displaces the strand section into an outfeed device. This equipment is associated with the drawback that there is required for each strand its own pivot mechanism, which, in turn, renders the installation and equally also the additional cooling bed-pusher device, more expensive and more prone to malfunction.

With another prior art multistrand continuous casting installation there is located below the level of the outfeed or transfer roller table a first transverse transport device composed of an endless transport chain, which merges with a cooling bed arranged laterally of the outfeed device. With the aid of pivotal levers operatively associated with each strand and rotatably mounted between the level of the roller table and the cooling bed, and which pivotal levers are equipped with receiver means for displacement of the strand sections from the roller table, it is possible to individually downwardly pivot or rock the cut-to-length strand section and to deposit such strand section, which by virtue of the construction of the receiver means experiences a rotation through 90°, upon a stationary transverse conveyor belt or band. This transverse conveyor belt or band then moves the strand in the direction of the cooling bed. As soon as the strand sections have reached the operable region or zone of a second transverse transport device, installed at the cooling bed and in the form of a transverse drag mechanism, they are conjointly dragged or pulled, along with the already there deposited strand sections, in the direction of the outfeed device. Such type outfeed equipment is quite complicated in its construction. The pivot levers which are operatively associated with the individual strands must be pivoted independently of one another, which, depending upon the number of strands, requires the use of a multiplicity of pivot mechanisms. There are required two transverse transport devices. These devices, in turn, appreciably increase the costs of the installation.

SUMMARY OF THE INVENTION

Therefore, with the foregoing in mind it is a primary object of the present invention to provide an improved apparatus for the removal and simultaneous turning of cut-to-length hot strand sections from the run-out roller tables of a multistrand continuous casting installation which is not associated with the aforementioned drawbacks and limitations of the prior art discussed above.

Another and more specific object of the present invention aims at avoiding the above-explained disadvantages, and specifically, providing a constructionally simple apparatus of the character described, by means of which cut-to-length strand sections can be functionally reliably turned through 90° from the run-out roller tables and transferred directly to the cooling bed. A further significant object of the present invention aims at a new and improved construction of strand section-transfer apparatus which enables removal and simultaneous turning of cut-to-length strand sections and deposition thereof upon a cooling bed, which transfer apparatus is relatively simple in construction and design, economical to manufacture, not readily subject to breakdown or malfunction, requires a minimum of maintenance and servicing, and affords positive and reliable transfer of the strand sections between the roller tables and a cooling bed.

Now in order to implement these and still further objects of the invention, which will become more readily apparent as the description proceeds, the apparatus of the present development is manifested by the features that the means defining the axis of rotation of the pivotal lever, for instance constituted by a pivot shaft, and which pivotal lever is provided with receiver means containing support surfaces enclosing an angle with one another for receiving the strand section located farthest from the cooling bed, is disposed below the level of the cooling bed approximately at the central region between the cooling bed and the run-out roller table located farthest from the cooling bed. Each pivotal lever is provided with lever flank or surface means, confronting the cooling bed, which have an arc-shaped or curved configuration in order to push or displace the neighboring strand section. The run-out roller table situated closest to the cooling bed is provided with a partially descending slide or chute which opens into the plane of the cooling bed.

By virtue of the low or sunk position of the pivot shaft there is attained a pivotal range of the lever between the cooling bed and the run-out roller table which is located farthest from the cooling bed. In this way, and also by virtue of the construction of the strand section-receiver means and also the slide or chute member, it is possible to transfer a number of strand sections, turned through 90°, simultaneously from different run-out roller tables conjointly, with the aid of only one single pivot mechanism or device, directly onto the cooling bed. With this solution it is possible to beneficially dispense with the use of additional, complicated conveying means, such as transport belts and transverse drag or pulling devices or the like.

The rotation of the individual strand sections ensures that the strand ends which have become enlarged or widened, due to the cutting or shearing operation, assume an essentially vertical end position, so that these strand sections flushly come to lie next to one another and there can be avoided any disadvantageous bending-through of the strand sections during the shifting or displacement thereof. There are not required any additional turning devices for the strand sections.

According to a further proposal of the invention it is possible to augment the above-discussed equipment in that the pivotal lever is provided with a respective tilting joint or link arrangement. In this way there is rendered possible a pivoting back of the pivotal lever even then when subsequent strand sections again partially extend into the pivotal range of the pivotal lever. Consequently, there is afforded shortening of the equalization or compensation path for the strands which travel irregularly as a function of time.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top plan view of an inventive outfeed or transfer apparatus for a twin strand-billet-continuous casting installation;

FIG. 2 is an enlarged vertical sectional view of the arrangement of FIG. 1, taken substantially along the line II—II thereof; and FIG. 3 is a fragmentary detailed side view of a modified construction employing a pivotal lever equipped with a tilting joint or link arrangement.

DETAILED DESCRIPTION OF THE PREFERRED EMBODIMENTS

Describing now the drawings, it is to be understood that only enough of the continuous casting installation and the apparatus for the removal and simlutaneous turning of cut-to-length hot strand sections has been shown as will enable those skilled in the art to readily understand the underlying principles and concepts of the invention and to simplify the illustration. Turning attention now to FIGS. 1 and 2, the arrows 31 and 32 generally designate the outfeed direction of strands emanating from a twin strand-billet-continuous casting installation, by way of example. Following the strand cutters or shears 3 and 4, serving to cut-to-length the strands, are the compensation roll tables, generally designated by reference characters 5' and 6', whose driven rolls 5 and 6, respectively, transport in an accelerated fashion the relevant strand sections to an outfeed or transfer device 7. This outfeed or transfer device 7 is composed of delivery or run-out roller tables 8 and 9, equipped with non-driven rolls 17, and a pivotal lever mechanism, generally designated by reference character 50, which is arranged between the run-out roller or roll tables 8 and 9. This pivotal lever mechanism 50, in the embodiment under consideration, will be seen to comprise three pivotal levers 11 which are secured to a common pivot shaft 10 or equivalent structure and a slide or chute means 13. The slide or chute means 13 consists of a number of segments 13' which extend from the run-out roller table 8 to a cooling bed 12 arranged laterally towards the left, viewed in the casting direction, and such slide or chute means or arrangement 13 merges with the plane of the cooling bed 12. The cooling bed 12 is located at the same level as the run-out or delivery roller tables 8 and 9. The pivotal shaft 10, defining an axis of rotation, is located below the level of the cooling bed 12 approximately at the center between the starting region of the cooling bed 12 and the run-out roller table 9 which is located furthest from such cooling bed 12 or equivalent structure.

Continuing, the supports of the cooling bed 12 have been generally designated by reference character 14 in FIG. 1. Fixed stops 15 and 16 are provided with not particularly illustrated but conventional switches at the end of the run-out roller tables 8 and 9. Upon actuation of both such switches by the strand sections 1' and 2' the pivot mechanism 50 is activated, and specifically moved with the aid of a conventional fluid operated piston-and-cylinder unit 18 in the direction of the cooling bed 12. This piston-and-cylinder unit 18 is flanged or otherwise suitably affixed at the related lever or lever member 11. Hence, by means of support or contact surfaces 20 of the pivotal levers 11 which are provided with the strand section-receiver means or receiving portions 19, and which support surfaces 20 extend in the illustrated starting position approximately horizontally, the strand section 2', located farthest from the cooling bed 12, is lifted off of the run-out roller table 9 and carried in the direction of the cooling bed 12. During the pivotal movement of the pivotal or pivotable levers 11, and upon passing the strand path of travel of the strand 1, the strand section of portion 1' which is located upon the run-out roller table 8 is pushed by means of the arcuate-shaped or curved configured lever flanks or surfaces 21 from the run-out roller table 8 and conveyed by means of the slide or chute arrangement 13 onto the cooling bed 12.

Details of the pivot mechanism 50 and the course of movement of the pivotal levers 11 during the pivoting operation will be apparent by referring to FIG. 2, wherein there has been shown in phantom lines one of the pivotal levers 11 during different points in time of its pivotal motion. By virtue of the position of the pivot shaft 10, approximately at the center between the cooling bed 12 and the most removed or furthest located run-out roller table 9, and which pivot shaft 10 is located below the common level or elevation of the cooling bed 12 and such run-out roller table 9, there is realized a pivotal range of each of the pivotal levers 11 from the run-out roller table 9 up to the region of the cooling bed 12. As will be apparent, the free lever ends 11', by virtue of the lowered position of the pivot shaft 10, pass through an arcuate-shaped path of travel 28, the apex 22 of which, in other words the point of the path of travel which intersects the vertical, is located above the level or elevation of the run-out roller table 9. In this way it is possible to realize the strived-for lifting of the strand section 2' from the run-out roller table 9 for the purpose of imparting a pivotal movement to such strand section 2'. This strand section 2' is raised by the approximately horizontally extending receiver surface 20, which also can extend at an inclination, from the run-out roller table 9 and slides, during the pivotal movement of the related lever 11, after passing the apex 22, onto the other support or contact surface of the related strand section-receiver means 19, so that this strand section 2' now comes to bear at another side surface thereof upon the receiver means 19. During deposition of the strand section 2' upon the cooling bed 12 this strand section 2' has completed a rotation about its lengthwise axis through 90°, with the result that the enlarged or widened strand ends 26 come to lie in a vertical position. The contact or support surfaces 20 of the receiver means 19, and which contact surfaces 20 have a thumb-shaped or bulbous portion 60 at their related end, as best seen by referring to FIG. 2, extend at the end of the pivotal path of movement between the cooling bed supports 14 and, thus, displace the strand sections reposing upon the cooling bed 12 in the outfeed direction thereof.

At the moment where the pivotal levers 11, during the rocking or pivotal motion thereof between the rolls 8' of the run-out roller table 8, pass through the outfeed path of travel of the strand 1, the strand section 1' is displaced from the run-out roller table 8, with the aid of the arcuate or curved-shaped lever flanks or surfaces 21, then slides upon a downwardly inclined portion or section 24 of the slide or chute arrangement 13, and during such sliding down motion carries out a rotation through approximately 90° and then is shifted further by means of an inclined portion 25 onto the cooling bed 12.

As best seen by referring to FIG. 3, the modified arrangement shown therein contemplates that the pivot levers 11 possess a tiltable joint or link arrangement 28' at the upper portion thereof, so that there is ensured for a return rocking of the lever 11 also in those instances where the strand section again protrudes into the delivery or run-out roller tables. The pivotal lever head portion or head 27, upon contact with a related strand section, is tilted in the direction of the arrow 29 and thereafter is returned by a suitable not particularly illustrated spring mechanism, back into its original or starting position. Such type tilting device enables shortening the length of the run-out roller tables, since it is not necessary to take into account the momentary position of the pivotal mechanism in relation to the outfeed of further strand sections.

The outfeed or transfer apparatus described for two strands is equally capable of use with three strand sections. In this case, there is provided at the end of each of the pivotal levers a further receiver means having two support or contact surfaces which form an angle with one another. With this modified construction of the levers, instead of raising only a single strand section from the run-out roller tables, there are raised two strand sections, these are turned and deposited upon the cooling bed. The configuration of the lever flanks or surfaces for the forward pushing of the third strand section remains unaltered. The position of the pivot shaft or axis, the inclination and length of the receiver surfaces must be coordinated to the encountered construction.

It should be apparent that the invention is in no way limited to the described twin strand-billet-continuous casting installation. With the inventive equipment it is also possible to equip continuous casting installations having a multiple of two or three strands. It is optional whether the additional cooling beds, required as a function of the number of strands, are arranged in tandem in the direction of strand travel or opposite one another.

Equally, it is not important for the cooling bed and the roller tables to be at the same elevation. With different elevations of these components the position of the pivot shaft and the length of the contact or support surfaces must be coordinated to one another such that there is ensured for a pivotal range between the furthest located run-out roller table and the cooling bed.

The invention also can be beneficially employed in conjunction with continuous casting installations for casting blooms. The number of pivotal levers which are to be provided per apparatus must be coordinated, in each case, to the length of the strand section and to the strand weight.

In the case of installations working with smaller, lighter strand sections the common pivot shaft or axis can be mounted so as to be raisable and lowerable in a manner wherein, upon return pivoting of the lever, the apex of the pivot path is located below the roller table-lever. A pivoting back of the levers, notwithstanding a strand section being located upon the roller tables, is thus possible, and therefore, there can be dispensed with the need for a long compensation path.

While there are shown and described present preferred embodiments of the invention it is to be distinctly understood that the invention is not limited thereto but may be otherwise variously embodied and practised within the scope of the following claims. Accordingly,

What I claim is:

1. An apparatus for the removal and simultaneous turning of cut-to-length hot strand sections from run-out roller tables of a multistrand continuous casting installation for metals, especially steel, and for the deposition of the removed strand sections upon a laterally arranged cooling bed, with the aid of pivotal lever means provided with receiver means for the strand sections, the improvement comprising:

means defining an axis of rotation for said pivotal lever means;

said receiver means of said pivotal lever means containing support surfaces enclosing an angle with one another and serving to receive a strand section located farthest from the cooling bed:

said means defining said axis of rotation being located below the level of the cooling bed approximately at the center between the cooling bed and the roller table located farthest from said cooling bed;

said pivotal lever means including lever flank means confronting said cooling bed for displacement of a neighboring strand section;

said lever flank means having a substantially arcuate-shaped configuration; and the run-out roller table situated closest to the cooling bed being provided with a partially descending slide means which merges with said cooling bed.

2. The apparatus as defined in claim 1, wherein:

said pivotal lever means is provided with tiltable joint means.

3. An apparatus for removing and simultaneously turning cut-to-length hot strand sections from run-out roller tables of a multistrand continuous casting installation for metals, especially steel, comprising:

a cooling bed for receiving the cut-to-length strand sections;

at least two run-out roller tables; one of said run-out roller tables first run-out roller table located farthest from said cooling bed and the other of said run-out roller tables defining a second run-out roller table located closer to said cooling bed;

pivotal lever means for transferring the strand sections from said first run-out roller table to said cooling bed;

said pivotal lever means including receiver means for taking-up a strand section for transfer to said cooling bed by said pivotal lever means;

means defining an axis of rotation for said pivotal lever means which is located below the level of the cooling bed approximately at the center between said cooling bed and said first run-out roller table;

said pivotal lever means including lever surface means confronting said cooling bed and serving to displace a neighboring strand section;

said lever surface means being configured for shifting a strand section in the direction of said cooling bed;

said second run-out roller table being provided with slide means, at least a portion of which has a descending configuration; and said slide means being directed towards said cooling bed.

4. The apparatus as defined in claim 3, wherein:

at least part of said lever surface means possesses a curved configuration.

5. The apparatus as defined in claim 3, wherein: said receiver means of said pivotal lever means possess contact surfaces enclosing an angle with one another and serving to receive a strand section located upon the first run-out roller table furthest from said cooling bed.

6. The apparatus as defined in claim 3, wherein:

said means defining said axis of rotation comprises a pivot shaft; and said pivotal lever means comprise a number of pivotal levers spaced in the axial direction of and upon said pivot shaft.

7. The apparatus as defined in claim 3, further including:

tiltable means provided for said pivot lever means.

8. An apparatus for removing and simultaneously turning cut-to-length hot strand sections from run-out roller tables of a multistrand continuous casting installation for metals, especially steel, comprising:

cooling bed means for receiving the cut-to-length strand sections;

at least two run-out roller tables;

one of said run-out roller tables defining a first run-out roller table located farthest from said cooling bed means and the other of said run-out roller tables defining a second run-out roller table located closer to said cooling bed means;

pivotal lever means for transferring the strand sections from said first run-out roller table to said cooling bed means;

said pivotal lever means including receiver means for taking-up a strand section for transfer to said cooling bed means by said pivotal lever means;

means defining an axis of rotation for said pivotal lever means which is located below the level of the cooling bed means at a location between said cooling bed means and said first run-out roller table;

said pivotal lever means including lever surface means confronting said cooling bed and serving to displace a strand section;

said lever surface means being configured for shifting a strand section in the direction of said cooling bed;

said second run-out roller table being provided with slide means, at least a portion of which has a descending configuration; and said slide means extending in the direction of said cooling bed means.

* * * * *